US008146834B2

(12) United States Patent
Freudenstein

(10) Patent No.: US 8,146,834 B2
(45) Date of Patent: Apr. 3, 2012

(54) CONCRETE CARRIAGEWAY FOR RAIL VEHICLES

(75) Inventor: Stephan Freudenstein, Neumarkt (DE)

(73) Assignee: Rail.One GmbH, Neumarkt (DE)

( * ) Notice: Subject to any disclaimer, the term of this patent is extended or adjusted under 35 U.S.C. 154(b) by 710 days.

(21) Appl. No.: 11/791,604

(22) PCT Filed: Nov. 26, 2005

(86) PCT No.: PCT/DE2005/002133

§ 371 (c)(1),
(2), (4) Date: Aug. 27, 2007

(87) PCT Pub. No.: WO2006/063550

PCT Pub. Date: Jun. 22, 2006

(65) Prior Publication Data

US 2008/0116290 A1 May 22, 2008

(30) Foreign Application Priority Data

Dec. 16, 2004 (DE) ..... 10 2004 061 165

(51) Int. Cl.
*E01B 1/00* (2006.01)

(52) U.S. Cl. ..... 238/2

(58) Field of Classification Search ..... 238/2, 3, 238/5, 6, 8, 24, 25
See application file for complete search history.

(56) References Cited

U.S. PATENT DOCUMENTS 4,905,896 A * 3/1990 Eisenmann et al. ..... 238/2

FOREIGN PATENT DOCUMENTS

| | | |
|---|---|---|
| DE | 37 36 943 | 12/1988 |
| DE | 94 15 311 | 11/1994 |
| DE | 297 21 515 | 1/1998 |
| DE | 197 08 896 | 10/1998 |
| DE | 199 47 882 | 4/2001 |
| DE | 102 00 852 | 7/2003 |
| EP | 1 039 030 | 9/2000 |
| EP | 1 231 323 | 8/2002 |
| EP | 1 298 251 | 4/2003 |
| GB | 2185046 | * 11/1985 |
| GB | 2 185 046 | 7/1987 |

* cited by examiner

*Primary Examiner* — Joe Morano, IV
*Assistant Examiner* — R. J. McCarry, Jr.
(74) *Attorney, Agent, or Firm* — Jordan and Hamburg LLP

(57) ABSTRACT

Concrete carriageway for rail vehicles, having single- or multiple-block sleepers embedded in a carriageway panel, whereby the carriageway panel has areas of thinned cross-section disposed transverse to the direction of travel for generating cracks and in each has at least one body for transmitting transverse forces which overlaps the region of thinned cross-section on both sides.

9 Claims, 2 Drawing Sheets

CONCRETE CARRIAGEWAY FOR RAIL VEHICLES

BACKGROUND OF THE INVENTION

The invention relates to a concrete carriageway for rail vehicles having single- or multiple-block sleepers embedded in a carriageway panel.

Concrete carriageways are usually used in sections of rail which are set up for high-speed and very high-speed trains. Instead of the conventional gravel ballast bed, in concrete carriageways a carriageway panel is provided into which the single- or multiple-block sleepers are embedded.

In conventional concrete carriageways, stray uncontrolled cracks may occur which are caused by longitudinal stresses. The occurrence of stray cracks is unwanted, as their position and continuation cannot be controlled.

The problem on which the invention is based is therefore to create an improved concrete carriageway in which the occurrence of stray cracks is prevented.

SUMMARY OF THE INVENTION

To achieve this, it is proposed in a concrete carriageway of the type mentioned in the introduction that the carriageway panel has areas of thinned cross-section disposed transverse to the direction of travel for generating cracks, and in each case at least one body for transmitting transverse forces which overlaps the region of thinned cross-section on both sides.

Due to the areas of thinned cross-section provided according to the invention in the carriageway panel, controlled cracking is achieved, and accordingly the occurrence of stray cracks is prevented. Due to the areas of thinned cross-section, the location of the crack can be fixed in a controlled manner. In order to meet the statutory requirements in spite of the areas of thinned cross-section disposed transverse to the direction of travel, the transmission of transverse forces from one segment of the carriageway panel to the adjacent one is effected by bodies for transmitting the transverse forces, which bodies are embedded during manufacture of the carriageway panel.

In the concrete carriageway according to the invention, the areas of thinned cross-section may be formed as grooves or joints or notches in the carriageway panel. These regions with a thinner cross-section may for example be produced by cutting or milling, the grooves and the like being applied to the carriageway panel subsequently.

In order to ensure a long service life of the concrete carriageway according to the invention, the areas of thinned cross-section may be sealed against environmental effects, in particular against penetrating damp. Thus damage due to penetrating water is effectively prevented.

The concrete carriageway according to the invention may be laid in such a manner that the formation of cracks may be triggered due to temperature fluctuations or temperature gradients in different regions of the concrete carriageway or due to shrinkage of the concrete. In a concrete carriageway laid in this manner, the cracks automatically form due to physical effects, so that it is not necessary to cause the cracks retrospectively by manual or mechanical means.

According to a further embodiment of the invention, it can be provided that the areas of thinned cross-section are formed as bodies embedded in the carriageway panel. These bodies can be concreted in during manufacture of the carriageway panel. The embedded body or bodies have the property of interrupting the transmission of force between the sections of carriageway panel abutting the bodies and act as pre-formed break points, which cause crack formation due to a temperature difference or other trigger for example. Alternatively, it can also be provided that a body embedded in the carriageway panel is removable after the thinned cross-sectional area has been produced. This variant may be considered if the embedded body is located at the surface of the carriageway panel.

According to the invention, the embedded body may be rod-shaped and have a rectangular or wedge-shaped or sword-shaped profile. Alternatively, the embedded body may be formed two-dimensionally, e.g. as a foil, plate or slab or as a textile. The embedded body or bodies is/are advantageously embedded transverse to the carriageway and to the direction of travel and interrupt the concrete carriageway as a whole or in part in the transverse direction.

In the carriageway according to the invention, particularly advantageously the following materials are used for manufacturing the embedded body: steel, concrete, wood, plastics material.

It is particularly preferred that the bodies of the carriageway according to the invention which transmit the transverse forces are formed as a rods or bars or as horizontal dowels. A particularly efficient transmission of transverse forces is achieved if the bodies for transmitting transverse forces are aligned in the direction of travel, i.e. in the longitudinal direction of the concrete carriageway.

In order to simplify the manufacture of the concrete carriageway according to the invention, plural bodies for transmitting the transverse forces can be used pre-assembled and spaced apart. Preferably, the bodies for transmitting the transverse forces may be inserted into a holding device, e.g. consisting of wire, before the carriageway panel is manufactured or may be connected together, spaced apart, in order to fix their position.

A particularly advantageous fixing option for the bodies for transmitting the transverse forces is achieved if the bodies penetrate the grid reinforcement of the sleepers or are fixable laterally and/or below to projecting sections of the grid reinforcement of the sleepers or to another suitable section of the sleepers.

In the concrete carriageway according to the invention the length of a body for transmitting the transverse forces may be 400 to 600 mm, preferably 500 mm. The diameter of a body for transmitting the transverse forces may be 20 to 35 mm, preferably 25 mm. The distance between two bodies for transmitting transverse forces may be 200 to 500 mm, preferably 250 to 300 mm.

A body for transmitting transverse forces may consist of steel, plastics or concrete or a combination of these materials, preferably the body may be produced from reinforced concrete or plastics fibres. It is also possible for a body for transmitting transverse forces to have a coating, in particular a corrosion protection coating or a plastics casing.

A further advantage of the concrete carriageway according to the invention is that the carriageway panel has no or at least no continuous longitudinal reinforcement.

The substructure of the carriageway panel of the concrete carriageway according to the invention may comprise a bonded or non-bonded support layer, e.g. a hydraulic bonded support layer, a layer of ballast, a frost protection layer, a foil or a geotextile. A hydraulically bonded support layer may have at its surface projecting anchoring elements acting as supports for the bodies for transmitting transverse forces. The concrete carriageway may also be mounted on a smooth base. Further, separating, sliding, elastomer or drainage layers can be laid between the concrete carriageway and the substructure.

The support layer of the concrete carriageway, in particular a hydraulically bonded support layer, may have areas of thinned cross-section disposed transverse to the direction of travel, in particular grooves or joints or notches. Optionally, the concrete carriageway and the substructure can be connectable or connected together via friction, cams, elements for transmitting transverse force, in particular dowels, or via a connecting reinforcement.

Further advantages and details of the invention will appear from the following description of embodiments and from the accompanying drawings.

DESCRIPTION OF THE PREFERRED EMBODIMENTS

Figure 1:
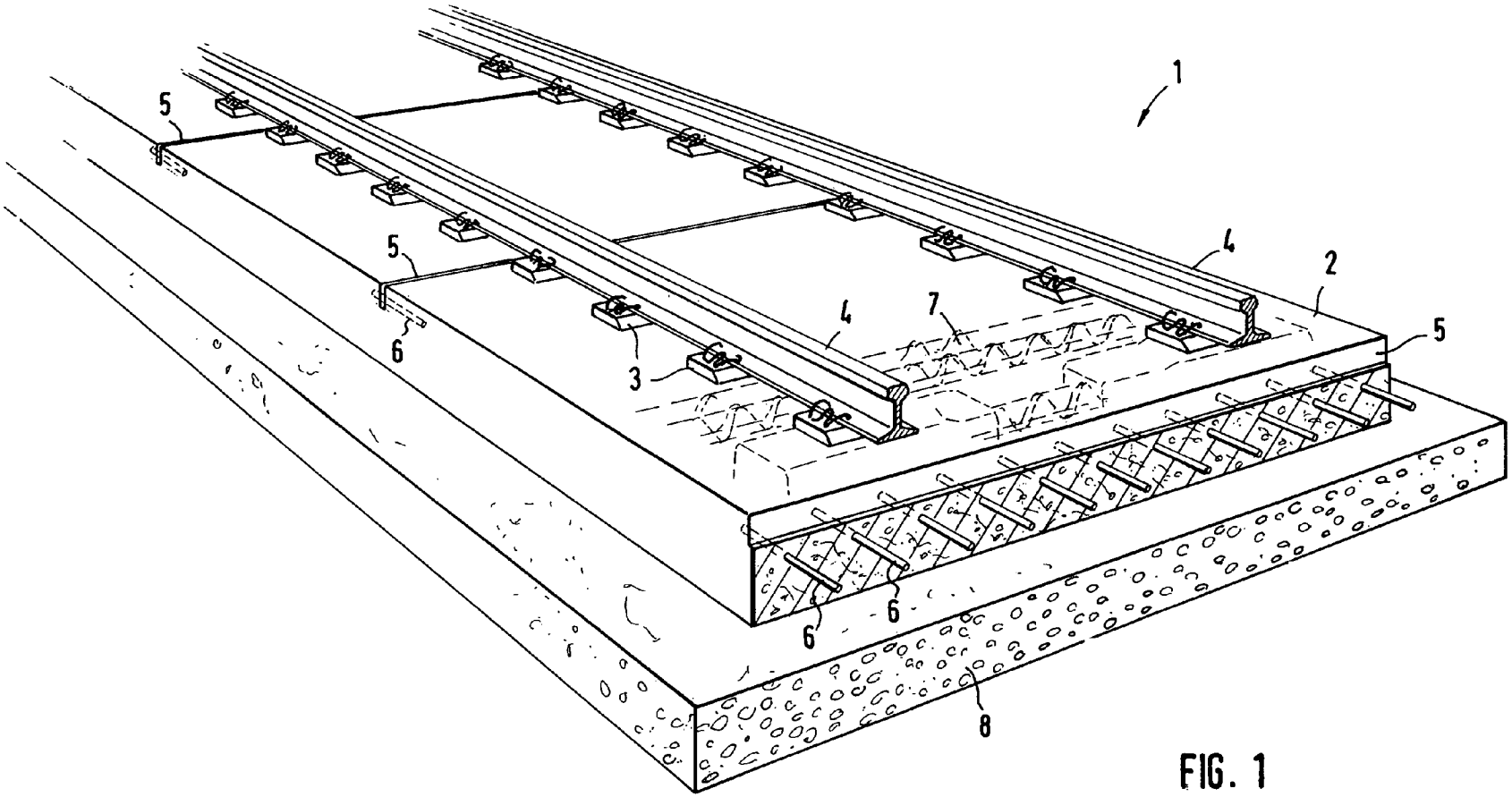
FIG. 1, a first embodiment of a concrete carriageway according to the invention.

FIG. 1 is a perspective diagram of a concrete carriageway formed as a fixed carriageway 1. The fixed carriageway 1 comprises a carriageway panel 2, which in the example shown has a height of about 350 mm. Grooves 5 of predetermined depth and width are cut in the carriageway panel 2 at regular intervals to form areas of thinned cross-section extending transverse to the direction of travel. If temperature fluctuations, temperature gradients and/or shrinkage of the concrete occur, these grooves effect controlled crack formation, so that the grooves 5 formed at the surface of the carriageway panel 2 break right through. Thus the formation of stray cracks on the carriageway panel 2 is avoided. As can be seen from FIG. 1, in the region of the grooves 5 plural horizontal dowels 6 extending transverse to the grooves and parallel to the direction of travel are embedded in the carriageway panel 2 as bodies for transmitting transverse forces. The horizontal dowels 6 are disposed approximately symmetrically to the respective groove 5, so that approximately half the length of a horizontal dowel 6 is located in one section of the carriageway panel 2 and the other half in the adjacent section of the carriageway panel 2. The horizontal dowels 6 ensure transmission of the transverse forces between the individual sections of the carriageway panel 2 separated from one another by the groove 5 which is split through.

In the embodiment shown, one horizontal dowel has a length of 500 mm, the diameter is 25 mm, and the dowels 6 are fitted at a distance of 250 mm. As corrosion protection, each horizontal dowel 6 has a plastics coating. However, it is possible to deviate from these size details according to the respective requirements.

In order to simplify the fitting and positioning of the horizontal dowels 6, these are inserted respectively into the grid structure 7 of a dual-block sleeper 3. Due to the presence of grid structures 7, additional reinforcement of the fixed carriageway 1 in the transverse direction can be dispensed with. Further, due to the presence of horizontal dowels, an additional or separate longitudinal reinforcement of the fixed carriageway 1 can be dispensed with or can be considerably reduced. However, in special applications it may be practical to provide a longitudinal reinforcement at least in sections of the fixed carriageway 1 in addition to the horizontal dowels 6. By using the horizontal dowels 6, the further advantage is gained that no earthing of the horizontal dowels 6 acting as longitudinal reinforcement is required, or that this can be much simplified.

In the embodiment shown in FIG. 1, the carriageway panel 2 is constructed on a ballast support layer 8. Similarly, the carriageway panel can also be constructed on a frost protection layer, a foil, a geotextile, a hydraulically bonded support layer on a concrete slab or another bonded support layer.

Figure 2:
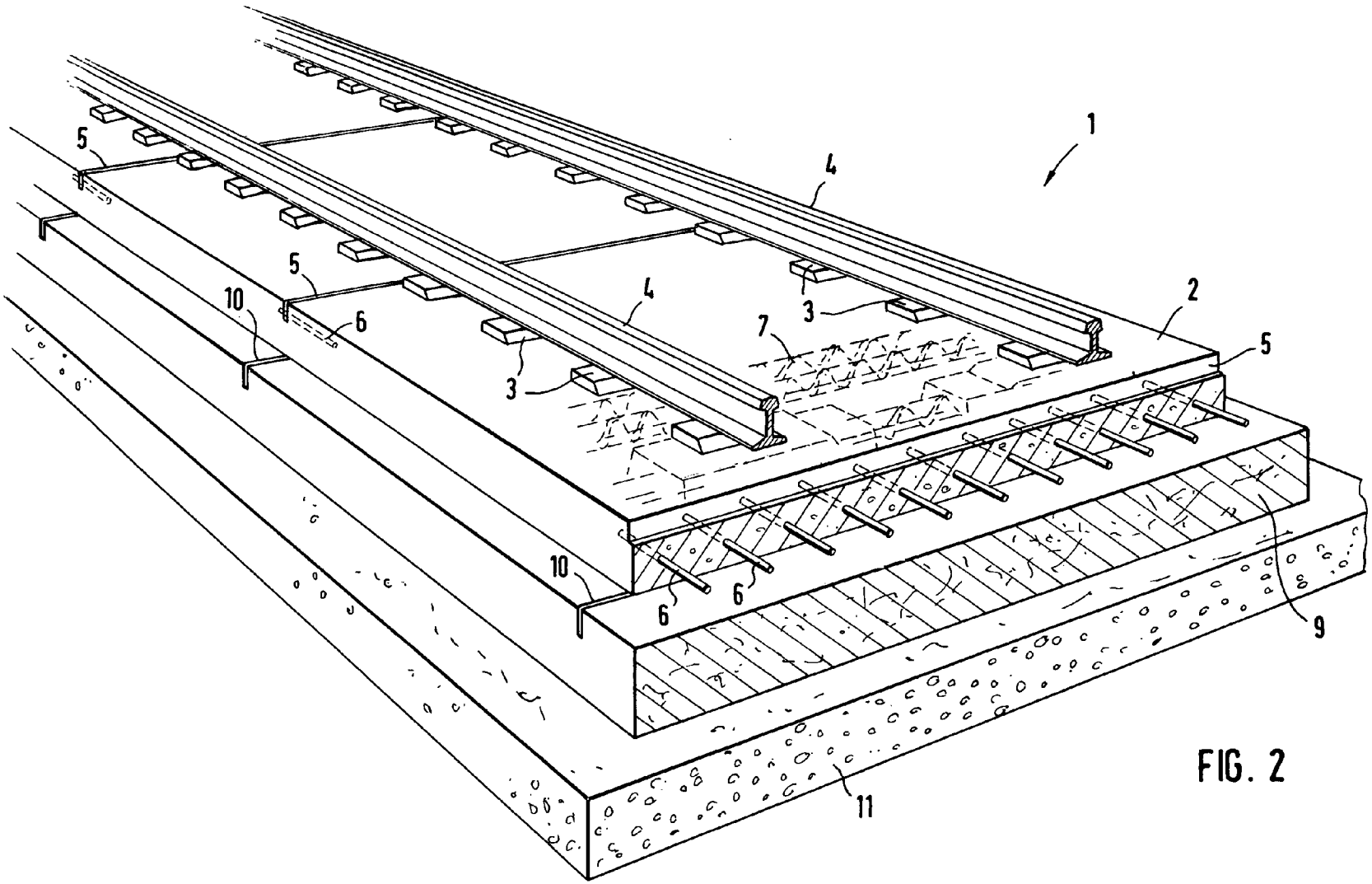
FIG. 2, a second embodiment of a concrete carriageway according to the invention.

FIG. 2 shows a second embodiment of the fixed carriageway according to the invention, the same components being provided with the same references as in FIG. 1.

As in FIG. 1, dual-block sleepers 3 are embedded in the carriageway panel 2, which are for the mounting of rails 4. The carriageway panel 2 has transverse grooves 5, which are filled with a casting compound. In the region of the grooves 5, horizontal dowels 6 extending in the direction of travel are disposed, which connect sections of the carriageway panel 2 separated by the grooves 5.

Unlike in the first embodiment, below the carriageway panel 2 is a hydraulically bonded support layer 9, which has a height of about 300 mm. In the hydraulically bonded support layer 9, the mineral aggregate mix is bonded by hydraulic bonding means.

As can be seen from FIG. 2, the hydraulically bonded support layer 9 also has grooves 10 extending in the transverse direction, which are located under the grooves 5 of the carriageway panel 2. In the case of temperature fluctuations, therefore, controlled crack formation occurs not only in the carriageway panel 2, but also in the hydraulically bonded support layer 9. Below the hydraulically bonded support layer 9 is a frost protection layer 11.

The invention claimed is:

1. A concrete carriageway for rail vehicles, comprising:

a single- or multiple-block sleepers embedded in a carriageway panel, the carriageway panel having areas of thinned cross-section extending transverse to the direction of travel from one edge of the carriageway panel to an opposite edge, said areas of thinned cross-section being formed as grooves or joints or notches in the carriageway panel, the areas of thinned cross-section being defined at least in part by at least one force transmission-interrupting body embedded in the carriageway panel, the at least one force transmission-interrupting body being comprised of a foil, plate, slab or textile; and at least one body for transmitting transverse forces, said at least one body extending across each of said areas of thinned cross-section, said at least one body further extending over at least a portion of the carriageway panel to span each side of the corresponding area of thinned cross-section, said at least one force transmission-interrupting body is located at a surface of the carriageway panel so as to be removable after corresponding areas of thinned cross-section have been generated.

2. A concrete carriageway according to claim 1, wherein said at least one force transmission-interrupting body is formed two-dimensionally.

3. A concrete carriageway according to claim 1, wherein the at least one force transmission-interrupting body is comprised of one of the following materials or a combination thereof: steel, concrete, wood, plastic material.

4. A concrete carriageway for rail vehicles, comprising:

a single- or multiple-block sleepers embedded in a carriageway panel, the carriageway panel having areas of thinned cross-section extending transverse to the direction of travel from one edge of the carriageway panel to an opposite edge, said areas of thinned cross-section being formed as grooves or joints or notches in the carriageway panel, the areas of thinned cross-section being defined at least in part by at least one force transmission-interrupting body embedded in the carriageway panel, the at least one force transmission-interrupting body being comprised of a foil, plate, slab or textile; and at least one body for transmitting transverse forces, said at least one body extending across each of said areas of thinned cross-section, said at least one body further extending over at least a portion of the carriageway panel to span each side of the corresponding area of thinned cross-section, wherein the at least one body for transmitting transverse forces penetrates a grid reinforcement of the sleepers and may be fixed to a grid reinforcement projecting at the sides or below or to another section of the sleepers.

5. A concrete carriageway, comprising:

a single- or multiple-block sleepers embedded in a carriageway panel, the carriageway panel having areas of thinned cross-section wherein each one area of thinned cross-section extends transverse to the direction of travel from one edge of the carriageway panel to an opposite edge, said each one area being formed as a groove or joint or notch in the carriageway panel; and for said each one area, at least one body, extending over at least a portion of the carriageway panel to span each side of the corresponding area of thinned cross-section, for transmitting transverse forces, a substructure of the carriageway panel comprising a hydraulically bonded support layer, a ballast support layer, a frost protection layer, a foil, a geotextile, or a bonded support layer.

6. A concrete carriageway according to claim 5, wherein the hydraulically bonded support layer has areas of thinned cross-section disposed transverse to the direction of travel in the form of grooves or joints or notches.

7. A concrete carriageway for rail vehicles, comprising a single- or multiple-block sleepers embedded in a carriageway panel, the carriageway panel having areas of thinned cross-section disposed transverse to the direction of travel for generating cracks and in each case has at least one body for transmitting transverse forces which overlaps the region of thinned cross-section on both sides, wherein the substructure of the carriageway panel comprises a hydraulically bonded support layer, a ballast support layer, a frost protection layer, a foil, a geotextile, or a bonded support layer, and wherein the hydraulically bonded support layer has anchoring elements projecting at its upper face and acting as supports for the bodies for transmitting transverse forces.

8. A concrete carriageway for rail vehicles, comprising a single- or multiple-block sleepers embedded in a carriageway panel, the carriageway panel having areas of thinned cross-section disposed transverse to the direction of travel for generating cracks and in each case has at least one body for transmitting transverse forces which overlaps the region of thinned cross-section on both sides, wherein the substructure of the carriageway panel comprises a hydraulically bonded support layer, a ballast support layer, a frost protection layer, a foil, a geotextile, or a bonded support layer, and wherein the hydraulically bonded support layer has areas of thinned cross-section disposed transverse to the direction of travel.

9. A concrete carriageway for rail vehicles, comprising a single- or multiple-block sleepers embedded in a carriageway panel, the carriageway panel having areas of thinned cross-section disposed transverse to the direction of travel for generating cracks and in each case has at least one body for transmitting transverse forces which overlaps the region of thinned cross-section on both sides, wherein the substructure of the carriageway panel comprises a hydraulically bonded support layer, a ballast support layer, a frost protection layer, a foil, a geotextile, or a bonded support layer, and wherein the concrete carriageway and the substructure are connectable or are connected together via friction, cams, or elements transmitting a transverse force.

* * * * *